US011447981B2

(12) United States Patent
Fauvel et al.

(10) Patent No.: US 11,447,981 B2
(45) Date of Patent: Sep. 20, 2022

(54) SMART LOCK HAVING AN ELECTROMECHANICAL KEY WITH THREE POSITIONS

(71) Applicant: NETATMO, Boulogne-Billancourt (FR)

(72) Inventors: Damien Fauvel, Chatillon (FR); Minglai Chen, Ivry sur Seine (FR); Romain Cazalis, Viroflay (FR); Martin Lespinasse, Boulogne-Billancourt (FR); Frédéric Potter, Neuilly-sur-Seine (FR)

(73) Assignee: NETATMO, Boulogne-Billancourt (FR)

( * ) Notice: Subject to any disclaimer, the term of this patent is extended or adjusted under 35 U.S.C. 154(b) by 946 days.

(21) Appl. No.: 16/223,692

(22) Filed: Dec. 18, 2018

(65) Prior Publication Data

US 2019/0203504 A1 Jul. 4, 2019

(30) Foreign Application Priority Data

Dec. 28, 2017 (EP) ..... 17306964

(51) Int. Cl.
*E05B 63/00* (2006.01)
*E05B 47/06* (2006.01)
(Continued)

(52) U.S. Cl.
CPC ..... *E05B 63/0065* (2013.01); *E05B 13/005* (2013.01); *E05B 47/0001* (2013.01);
(Continued)

(58) Field of Classification Search
CPC ..... E05B 2047/0094; E05B 47/00; E05B 2047/0026
See application file for complete search history.

(56) References Cited

U.S. PATENT DOCUMENTS 8,419,084 B2 * 4/2013 Ding ..... E05B 47/0012 292/144
2004/0040355 A1 * 3/2004 Goldman ..... E05B 47/0642 70/277
(Continued)

FOREIGN PATENT DOCUMENTS

CN 101014750 A 8/2007
CN 105989648 A 10/2016
(Continued)

OTHER PUBLICATIONS

European Search Report for EP 17306964, dated Jun. 21, 2018.
English Translation of Chinese Search Report issued in CN 109972920, dated Apr. 3, 2020.

*Primary Examiner* — Vernal U Brown
(74) *Attorney, Agent, or Firm* — Meagher Emanuel Laks Goldberg & Liao, LLP

(57) ABSTRACT

The invention concerns a locking mechanism (10) comprising an indoor mechanical actuation lever (11), an outdoor mechanical actuation lever (12) and a lock clutch (13), each mechanical actuation lever being configured to switch between a closed configuration and an open configuration, wherein the lock clutch (13) is configured to take at least three positions:

- a first position where the lock clutch is disengaged from the indoor mechanical actuation lever and outdoor mechanical actuation lever,
- a second position where the lock clutch is engaged with the indoor mechanical actuation lever and outdoor mechanical actuation lever,
- a third position where the lock clutch is engaged with the indoor mechanical actuation lever and disengaged from the outdoor mechanical actuation lever.

13 Claims, 1 Drawing Sheet

(51) Int. Cl.

| | |
|---|---|
| ***G07C 9/28*** | (2020.01) |
| ***E05B 13/00*** | (2006.01) |
| ***E05B 47/00*** | (2006.01) |
| *E05B 43/00* | (2006.01) |
| *E05C 9/00* | (2006.01) |

(52) U.S. Cl.
CPC ..... *E05B 47/0676* (2013.01); *G07C 9/28* (2020.01); *E05B 43/005* (2013.01); *E05B 47/0638* (2013.01); *E05B 2047/0067* (2013.01); *E05B 2047/0094* (2013.01); *E05B 2047/0095* (2013.01); *E05C 9/00* (2013.01); *E05Y 2900/132* (2013.01)

(56) References Cited

U.S. PATENT DOCUMENTS

| | | | | |
|---|---|---|---|---|
| 2007/0115094 | A1 | 5/2007 | Gillert et al. | |
| 2010/0207206 | A1* | 8/2010 | Krischke ..... | H01L 29/7811 257/E29.262 |
| 2017/0053467 | A1 | 2/2017 | Meganck et al. | |
| 2017/0243425 | A1 | 8/2017 | Meganck et al. | |
| 2018/0030759 | A1* | 2/2018 | Chanbonpin ..... | E05B 63/0052 |

FOREIGN PATENT DOCUMENTS

| | | | | |
|---|---|---|---|---|
| CN | 108027992 | A | 5/2018 | |
| DE | 102014104092 | A1 | 10/2015 | |
| DE | 102014104139 | A1 * | 10/2015 | ..... E05B 47/0012 |
| DE | 102014104139 | A1 | 10/2015 | |
| DE | 102015102205 | A1 | 8/2016 | |
| EP | 1774124 | A1 | 4/2007 | |
| WO | 2005124069 | A1 | 12/2005 | |
| WO | 2014209217 | A1 | 12/2014 | |
| WO | 2015/144535 | A1 | 10/2015 | |

* cited by examiner

SMART LOCK HAVING AN ELECTROMECHANICAL KEY WITH THREE POSITIONS

FIELD

The invention relates to the field of secure key control and concerns a locking mechanism configured to equip an opening unit having at least three positions to increase security. The invention also concerns a method for switching a locking mechanism from a position to another one.

BACKGROUND

Electromechanical lock and key with identification code are widespread. They enable authorized key holders to have access to locked rooms if the identification code of the key corresponds to a predetermined code in relation with the electromechanical lock. The key may be an ordinary looking key to insert into the lock or an access badge to pass in front of the lock.

The electromechanical lock comprises a processor configured to compare the identification code of the key with the predetermined code. If the identification code corresponds to the predetermined code, the electromechanical lock switches from its locked state to its unlocked state.

Commonly locks are formed with a body that can be easily unscrewed by a locksmith to facilitate rekeying. The body has the function to lock and unlock the lock. A lock body may be found under the form of a European cylinder (defined by the DIN18251). A European cylinder is a type of lock cylinder. There exist other profiles of lock bodies like the oval cylinder that is used in the Nordic countries. A body may not be in the form of a cylinder. A lock body may be inserted into a lock or a mortise lock or a slot-in lock. This function offers the advantage of allowing its change without altering the boltwork hardware. Removing the body typically requires only loosening a set screw, then sliding the body from the boltwork.

Due to the increasing number of attempts to force locks, there is a growing interest in devices enabling to ensure a certain level of security. Moreover real estate developers and insurance companies impose more and more stringent constraints to ensure that locks remain securely fastened.

Existing locks have a lock clutch that is either engaged with the mechanical actuation levers positioned on the inside and on the outside of the opening unit, or disengaged from them. Generally when the user is in the room, he wants to be able to go out without having to unlock the door. Therefore the lock clutch usually stays in the engaged position. This means that an ill-intentioned person may come in and steal or damage something or hurt someone, especially when the user is inside. There is therefore a need for a lock that is not locked when the user wants to exit the room, while being locked to persons who would like to enter the room from the outside. Such a lock would thus be user friendly while complying with strict security standards.

There is consequently a need for a locking mechanism with upgraded security features while still being user-friendly.

SUMMARY OF THE INVENTION

A solution to overcome this drawback is to provide a locking mechanism having, additionally to the engaged or disengaged position of the lock clutch, a position where the lock clutch is engaged with the indoor mechanical actuation lever and disengaged from the outdoor mechanical actuation lever, thus making the outside handle disconnected when the user wants to prevent access from the outside while leaving the lock unlocked when maneuvered from the inside.

To this end, the subject of the invention is a locking mechanism comprising an indoor mechanical actuation lever, an outdoor mechanical actuation lever and a lock clutch, each mechanical actuation lever being configured to switch between a closed configuration and an open configuration, wherein the lock clutch is configured to take at least three positions:

- a first position where the lock clutch is disengaged from the indoor mechanical actuation lever and outdoor mechanical actuation lever,
- a second position where the lock clutch is engaged with the indoor mechanical actuation lever and outdoor mechanical actuation lever,
- a third position where the lock clutch is engaged with the indoor mechanical actuation lever and disengaged from the outdoor mechanical actuation lever.

According to an embodiment of the invention, the locking mechanism is configured to cooperate with at least one identification key having an identification code; each mechanical actuation lever being configured to switch between the closed configuration and the open configuration when moved if the identification code of the at least one identification key is an authorized code of the locking mechanism.

The locking mechanism according to the invention may comprise a processor configured to read the identification code of the at least one identification key and determine if the identification code is an authorized code of the locking mechanism.

The locking mechanism according to the invention may comprise a movement sensor configured to detect an authorized movement of the outdoor mechanical actuation lever, wherein the processor is configured to send to the lock clutch through a communication link a switching command from the first position to the second position and vice versa, or from the third position to the second position if the movement sensor detects an authorized movement of the outdoor mechanical actuation lever.

According to the invention, the processor may be further configured to send to the lock clutch through a communication link a switching command from the second position to the third position, after a predetermined duration of inactivity of the locking mechanism.

The processor may be further configured to send to the lock clutch switching commands between the second position and the third position, according to a predetermined schedule.

According to the invention, the locking mechanism may further comprise an access to a presence sensor, wherein the processor is further configured to send to the lock clutch switching commands between the second position and the third position according to a determination by the presence sensor of an indoor presence of a user.

According to an embodiment of the invention, the at least one identification key is a remote control and the processor is configured to receive from the remote control a switching command from any one of the three positions to any other one and to send to the lock clutch through a communication link said switching command.

The invention also relates to a locking system comprising the locking mechanism according to the invention and the at least one identification key, wherein the at least one identification key comprises a transmitter of the identification code.

The at least one identification key may be a remote control or an electronic key.

The at least one identification key being a remote control, the remote control may be a smart phone configured to receive the identification code from an external connection or generate the identification code.

The invention also relates to a method for switching a locking mechanism from a position to another one, the locking mechanism comprising an indoor mechanical actuation lever, an outdoor mechanical actuation lever and a lock clutch, the lock clutch being configured to take three positions:

- a first position where the lock clutch is disengaged from the indoor mechanical actuation lever and outdoor mechanical actuation lever,
- a second position where the lock clutch is engaged with the indoor mechanical actuation lever and outdoor mechanical actuation lever,
- a third position where the lock clutch is engaged with the indoor mechanical actuation lever and disengaged from the outdoor mechanical actuation lever, the locking mechanism being configured to cooperate with at least one identification key having an identification code, the indoor, respectively outdoor, mechanical actuation lever being configured to switch between a closed configuration and an open configuration when moved if the lock clutch is engaged with the indoor, respectively outdoor, mechanical actuation lever and the identification code of the at least one identification key is an authorized code of the locking mechanism, the method comprises the steps of cooperating the at least one identification key with the locking mechanism, moving the indoor, respectively outdoor, mechanical actuation lever, switching the lock clutch.

The method according to the invention may comprise the steps of reading the identification code of the at least one identification key by the processor, determining by the processor if the identification code is an authorized code of the locking mechanism.

BRIEF DESCRIPTION OF THE DRAWINGS

The accompanying drawings illustrate various non-limiting, exemplary, innovative aspects in accordance with the present descriptions.

For the sake of clarity, the same elements have the same references in the various figures.

DETAILED DESCRIPTION

As previously mentioned, although many of the features of this invention are described in relation to a door, it is understood that they are generally applicable to any opening unit, such as a window. Moreover, these features are also applicable to many other devices, for example a padlock, having a locked state and an unlocked state.

Figure 1:
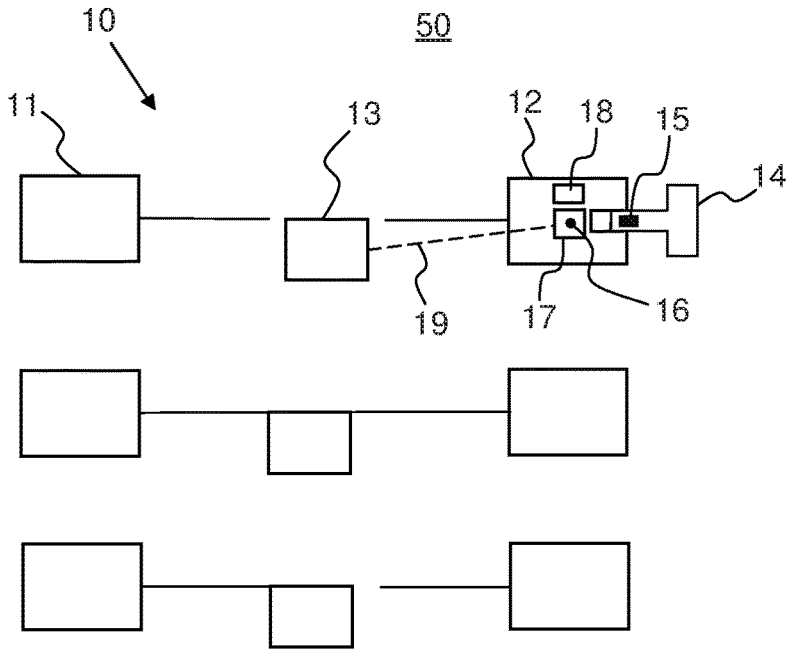
FIG. 1 schematically represents a first embodiment of a locking mechanism according to the invention.

FIG. 1 schematically represents a first embodiment of a locking mechanism 10 according to the invention. The locking mechanism 10 comprises an indoor mechanical actuation lever 11, an outdoor mechanical actuation lever 12 and a lock clutch 13. Each mechanical actuation lever 11, 12 is configured to switch between a closed configuration and an open configuration. The mechanical actuation levers 11, 12 may for example be door handles or door knobs and their actuation is performed by turning or pushing the door handle or the door knob, so as to switch between a closed and an open configuration of the door.

In order to illustrate the invention, the explanations are related to a door. Note that these explanations may be applied similarly to any opening unit. A door is an opening unit enabling the access to a room (or from a room to the outside) through an aperture. The door is connected to a door frame that frames the aperture and is fixed to the walls around the aperture. In an unlocked state of the door, the door is mobile in relation to the door frame, typically mobile in rotation around doors hinges (or in translation in the case the door and the door frame are configured to let the door slide through a part of the door frame and into the wall). The door may be in an open configuration or a closed configuration. In the closed configuration, the door covers the aperture (i.e. no one can go through the aperture). Typically the door is equipped with a locking mechanism. The locking mechanism has a latch that is either inserted into a slot of the door frame (the door is closed) or put inside the door (the door is not more fixed to the door frame and may be open). In the closed configuration, the latch is inserted into the slot of the door frame. In existing locking mechanisms, a lock clutch is connected to the latch. The lock clutch is usually engaged with both the indoor and outdoor door knobs. This enables a user to activate the lock clutch to make the latch move by moving one of the door knobs. Therefore a user has to move a door knob of the door to switch from the closed configuration of the door to the open configuration of the door. Indeed, the lock clutch being engaged with the knob, the movement of the knob commands the movement of the latch. Moving the door knob makes the latch retract into the door. The user can pull or push the door to open it.

In the closed configuration of the door, the locking mechanism can be either in a locked state or an unlocked state. The unlocked state corresponds to the case discussed above. The door may be opened by a user when activating a door knob and pushing or pulling the door. More precisely, the locking mechanism has a deadbolt entirely positioned inside the locking mechanism in the unlocked state. In the locked state, this deadbolt projects beyond the locking mechanism and is inserted into a slot of the door frame, thus locking the door to the frame. The movement of the deadbolt can be mechanically obtained, for example by a rotation of a key inserted into the locking mechanism. The rotation of the key clockwise, respectively anticlockwise, causes the deadbolt to translate either outside the locking mechanism to be inserted into the slot of the door frame, or inside the locking mechanism. To switch from the locked state of the door to the unlocked state of the door, a user has to rotate the key with the corresponding rotation of the key inside the locking mechanism. Then, to open the door, the user has to move a door knob of the door, as explained before.

This previous case corresponds to a single-point lock mechanism (i.e. with a single deadbolt). The invention similarly applies to a multi-point lock mechanism. A multi-point lock, also known as a safety lock, provides extra security as it distributes the locking points (i.e. a plurality of deadbolts) over the entire door. The most common multi-point lock is the three-point lock composed of a main deadbolt in the center and two other bolts at the top and at the bottom actuated by a rod. Some multi-point locks may have up to ten locking points.

According to the invention, the lock clutch 13 is configured to take at least three positions, even if it's obvious that the door itself can only be closed or open (two positions). It may take a first position where the lock clutch 13 is disengaged from the indoor mechanical actuation lever 11 and outdoor mechanical actuation lever 12. Or it may take a second position where the lock clutch 13 is engaged with the indoor mechanical actuation lever 11 and outdoor mechanical actuation lever 12. Or it may take a third position where the lock clutch 13 is engaged with the indoor mechanical actuation lever 11 and disengaged from the outdoor mechanical actuation lever 12. This third position enables to disconnect the outdoor mechanical actuation lever 12 when the user wants to prevent the door being opened from the outside while being freely openable from the inside.

In other words, the lock clutch 13 may be fully disengaged from the indoor and outdoor door knobs (first position, on the top of FIG. 1). This first position is adopted for example when nobody is at home and the user wants to keep the door in the closed configuration. In this first position, an unauthorized person may come and actuate any of the door knobs, but only the knobs can be turned. And since the lock clutch 13 is not engaged with the knobs, there is no possibility to open the door. Thanks to the invention, the actuation of the door knob cannot be mechanically transmitted to the lock clutch 13. In this position, the door cannot switch from the closed configuration to the open configuration.

The clutch lock 13 may be fully engaged with the indoor and outdoor door knobs (second position, in the middle of FIG. 1). This second position is advantageously adopted for example when the user, or any authorized person, is at home and wishes to go in and out without having to unlock the door. Since the clutch lock 13 is engaged from both sides of the door, the indoor door knob has only to be turned to open the door (i.e. switch the door from the closed to the open configuration). Similarly, once closed again (for example after leaving the house), the outdoor door knob has only to be turned to open the door (for instance to come back home after having left the house for a short period of time or when in the garden).

The clutch lock 13 may be only engaged with the indoor door knobs (third position, on the bottom of FIG. 1). This third position is adopted for example when the user, or any authorized person, is at home and wishes to go out without having to unlock the door, but does not want a person coming from outside to have the possibility to open the door. Since the clutch lock 13 is engaged from the indoor side, the indoor knob has only to be turned to switch the door from the closed configuration to the open configuration. But since the clutch lock 13 is disengaged from the outdoor side, someone outside the room may come and actuate the outside door knob (i.e. the outside door knob may be turned), there is no possibility to open the door. Indeed, the clutch lock 13 is only engaged with the indoor door knob and is not engaged with the outdoor door knob. Therefore the clutch lock 13 cannot be actuated from the outside, even if someone actuates the outdoor door knob. In this third position, the actuation of the outdoor door knob cannot be mechanically transmitted to the lock clutch 13. In this third position, the door advantageously cannot switch from the closed configuration to the open configuration when the outdoor mechanical actuation lever is activated from the outside but it can be opened by someone based inside the room. As a summary, in this embodiment, disconnecting the outdoor mechanical actuation lever increases the security of the locking mechanism. Nevertheless, the door can switch from the closed configuration to the open configuration when the indoor mechanical actuation lever is activated from the inside.

In another embodiment of the invention, the locking mechanism 10 may be configured to cooperate with at least one identification key 14, having an identification code 15. Each mechanical actuation lever 11, 12 is configured to switch between the closed configuration and the open configuration when moved if the identification code 15 of the at least one identification key 14 is an authorized code 16 of the locking mechanism 10.

The locking mechanism 10 according to the invention comprises a processor 17 configured to read the identification code 15 of the at least one identification key 14 and determine if the identification code 15 is an authorized code 16 of the locking mechanism. The processor 17 of the locking mechanism 10 comprises an algorithm that is able to generate a plurality of codes. When moving an identification key 14 close to the locking mechanism 10, (i.e. until about 10 meters of the lock mechanism, for example thanks to the BLE technology, (acronym of Bluetooth™ Low Energy technology), one of the code generated by the algorithm of the processor 17 is transmitted from the processor 17 to the identification key 14. In return, the processor 17 should receive from the identification key 14 an authorized code, that is to say an identification code 16 corresponding to the code transmitted by the processor 17. There is a communication between the locking mechanism 10 and the identification key 14. And if the processor 17 receives from the identification key 14, as a response to its code, an authorized code, the identification key 14 is considered as an authorized key for switching the lock clutch 13 from its position to another one. The communication between the identification key and the locking mechanism may use a direct electrical contact, an RF communication link (NFC™, Bluetooth™, Wi-Fi™, Zigbee™ or other low power RF communication standard or proprietary means), an optical or an acoustical communication means.

According to another embodiment of the invention, the locking mechanism 10 may comprise a movement sensor 18 configured to detect an authorized movement of the outdoor mechanical actuation lever 12. The authorized movement may be for example a rotation of the key. In this embodiment, the processor 17 is configured to send to the lock clutch 13 through a wireless or wired communication link 19 a switching command from the first position to the second position and vice versa, or from the third position to the second position. In other words, an authorized person with the authorized identification key 14 (i.e. configured to cooperate with the locking mechanism 10) performing the authorized movement of the outdoor door knob can cause the lock clutch 13 to switch from its position to another one. For example, the lock clutch 13 may switch from its disengaged position on both sides to its engaged position on both sides, or from its engaged position on both sides to its disengaged position on both sides, or from its engaged position from inside and disengaged position from outside to its engaged position on both sides. The cooperation of a physical identification key with the locking mechanism comprises an insertion of the physical key into the key hole of the locking mechanism and an exchange of identification codes between the identification key and the processor of the locking mechanism. If the identification key is a remote control, the cooperation only comprises an exchange of identification codes between the identification key and the processor of the locking mechanism.

Optionally, the processor 17 may be further configured to send to the lock clutch 13 through a communication link 19 a switching command from the second position to the third position after a predetermined duration of inactivity of the locking mechanism 10. This means that when the lock clutch 13 is engaged with the inside and outside door knobs, the lock clutch 13 becomes disengaged from the outside door knob after a predetermined time lapse, for example 5 minutes or 30 minutes or some hours in predefined cases such as persons staying at home for a predefined period of time. This enables to disconnect the outside door knob when door should stay closed. This might be the case when a user came in or went out and did not disengage the outdoor door knob or after a certain period of time (cleaning service coming for 2 hours and leaving the house). Alternatively, the locking mechanism may automatically change state at predetermined hours of the day. For instance, entrance from outdoors may be prohibited from 10 am to 4 pm on week days and from 10 pm to 10 am on weekends. In an embodiment, the indoor part of the locking mechanism may be switched to an engaged state when a presence sensor detects an authorized user to be present in the room as he was authorized to enter, i.e. the door may be opened by actuating the indoor mechanical actuation lever, and to be switched to a disengaged state when a presence sensor detects nobody to be present in the room, i.e. the door cannot be opened by actuating the indoor mechanical actuation lever. In some embodiments, the presence sensor may be activated by a reception of an authorized identification code from a remote control. In some embodiments, the remote control may be an identification key. In some embodiments, the presence sensor may be a camera comprising a software that is configured to recognize a number of authorized users. Of course, usage of authorized keys, even in such time zones where door is supposed to stay closed will deactivate the system and allow opening the door.

Figure 2:
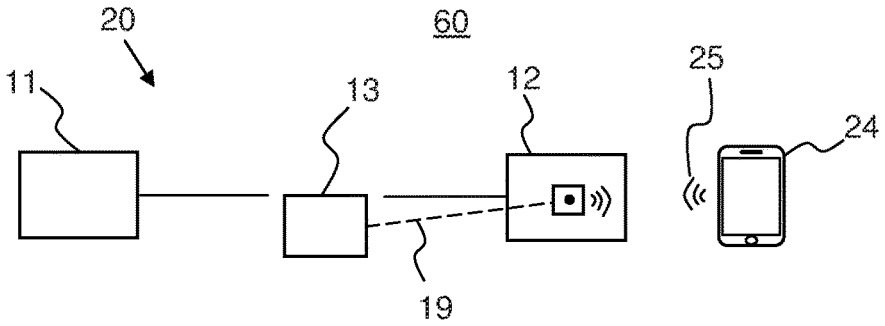
FIG. 2 schematically represents a second embodiment of a locking mechanism according to the invention.

FIG. 2 schematically represents a second embodiment of a locking mechanism 20 according to the invention. In this embodiment, the at least one identification key is a remote control 24 and the processor 17 is configured to receive from the remote control 24 a switching command from any one of the three positions to any other one and to send said switching command to the lock clutch 13 through a communication link 19. The remote control 24 may be a smart phone or a tablet. The communication between the processor 17 and the remote control 24 may operate for example through Wi-Fi™, NFC™ or Bluetooth™. The main advantage of this embodiment is the flexibility of the control. Indeed it is possible to switch from any one of the three positions to any other one thanks to the remote control 24. It is also possible to transfer the switching control to any other remote controls in case of need. For example, a person waiting for a postal package in his absence may send to the postman an authorized code valid for a predetermined time period. The postman may use his own smart phone with the downloaded authorized code to make the lock clutch 13 of the locking mechanism 20 switch from the first (or third) position (i.e. at least the outdoor actuation lever 12 is disengaged) to the second position (i.e. the outdoor actuation lever 12 is engaged) to come in and deliver the postal package. And even if the postman does not make the lock clutch 13 switch back to the second position, the processor 17 may be configured to send to the lock clutch 13 the command to switch back to the second position, as explained before, thus ensuring a high level of security, even if a person with a special authorization had a temporary control of the locking mechanism 20.

FIG. 1 and FIG. 2 both represent locking systems 50, resp. 60, incorporating embodiments of the invention, comprising the locking mechanism 10, resp. 20, and the at least one identification key 14, resp. 24, wherein the at least one identification key 14, resp. 24, comprises a transmitter of the identification code 15, resp. 25. The at least one identification key 14, 24 may be an electronic key 14 or a remote control 24. When the at least one identification key 24 is a remote control, the remote control may be a smart phone configured to receive the identification code from an external connection or generate the identification code.

Figure 3:
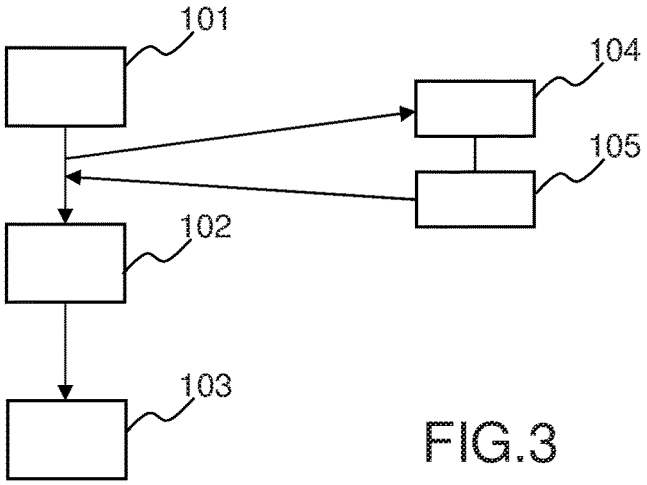
FIG. 3 represents a block diagram of the steps of a method for switching a locking mechanism from a position to another one according to the invention.

FIG. 3 represents a block diagram of the steps of a method for switching a locking mechanism 10 from a position to another one according to the invention. The locking mechanism 10 comprises an indoor mechanical actuation lever 11, an outdoor mechanical actuation lever 12 and a lock clutch 13. The lock clutch 13 is configured to take three distinct positions, as explained before. There are the first position where the lock clutch 13 is disengaged from the indoor mechanical actuation lever 11 and outdoor mechanical actuation lever 12, the second position where the lock clutch 13 is engaged with the indoor mechanical actuation lever 11 and outdoor mechanical actuation lever 12, and the third position where the lock clutch 13 is engaged with the indoor mechanical actuation lever 11 and disengaged from the outdoor mechanical actuation lever 12. The locking mechanism 10 is configured to cooperate with at least one identification key 14 having an identification code 16, each mechanical actuation lever 11, 12 being configured to switch between a closed configuration and an open configuration when moved if the lock clutch 13 is engaged with the mechanical actuation lever 11, 12 and the identification code 16 of the at least one identification key 14 is an authorized code of the locking mechanism 10. The method for switching the locking mechanism 10 from a position to another one comprises the steps of cooperating (step 101) the at least one identification key 14 with the locking mechanism 10, moving (step 102) a mechanical actuation lever 11, 12, and switching (step 103) the lock clutch 13.

In another embodiment, the locking mechanism 10 may comprise a processor 17. The method comprises the steps of reading (step 104) the identification code 16 of the at least one identification key 14 by the processor 17, and determining (step 105) if the identification code 16 is an authorized code of the locking mechanism 10. As mentioned before, when the identification key 14 is in the vicinity of the locking mechanism 10, or inserted into a key slot of the locking mechanism 10, the algorithm of the processor 17 generates a code which is transmitted from the processor 17 to the identification key 14. In return, the identification key 14 sends a corresponding code to the processor 17. The processor 17 should receive from the identification key 14 an authorized code, that is to say an identification code 16 corresponding to the code transmitted by the processor 17. There is a communication between the locking mechanism 10 and the identification key 14. The locking mechanism transmits a code to the identification key. The identification key sends to the locking mechanism (i.e. to the processor) another code, as a response to the received code. And if the processor 17 receives from the identification key 14, as a response to its code, an authorized code, the identification key 14 is considered as an authorized key for switching the lock clutch 13 from its position to another position. If the processor of the locking mechanism does not receive any code as a response to the transmitted code, nothing happens, the lock clutch stays in its current position. If the processor of the locking mechanism receives a code as a response to the transmitted code that is not an authorized code, the lock clutch stays in its current position.

The examples disclosed in this specification are therefore only illustrative of some embodiments of the invention. They do not in any manner limit the scope of said invention which is defined by the appended claims.

The invention claimed is:

1. A locking mechanism configured to cooperate with at least one identification key having an identification code, the locking mechanism comprising an indoor mechanical actuation lever, an outdoor mechanical actuation lever and a lock clutch, each mechanical actuation lever being configured to switch between a closed configuration and an open configuration, wherein the lock clutch is configured to take at least three positions:

a first position where the lock clutch is disengaged from the indoor mechanical actuation lever and outdoor mechanical actuation lever, a second position where the lock clutch is engaged with the indoor mechanical actuation lever and outdoor mechanical actuation lever, a third position where the lock clutch is engaged with the indoor mechanical actuation lever and disengaged from the outdoor mechanical actuation lever, each mechanical actuation lever being configured to switch between the closed configuration and the open configuration when moved if the identification code of the at least one identification key is an authorized code of the locking mechanism, the locking mechanism further comprising:

a processor configured to read the identification code of the at least one identification key and determine if the identification code is an authorized code of the locking mechanism, an access to a presence sensor, and the processor is further configured to send to the lock clutch switching commands to an engaged state when the presence sensor detects an authorized user to be present in the room as the authorized user was authorized to enter, and to be switched to a disengaged state when the presence sensor detects nobody to be present in the room.

2. The locking mechanism according to claim 1, wherein the sensor is a movement sensor configured to detect an authorized movement of the outdoor mechanical actuation lever, wherein the processor is configured to send to the lock clutch through the communication link the switching command from the first position to the second position and vice versa, or from the third position to the second position if the movement sensor detects an authorized movement of the outdoor mechanical actuation lever.

3. The locking mechanism according to claim 1, wherein the processor is further configured to send to the lock clutch through a communication link a switching command from the second position to the third position, after a predetermined duration of inactivity of the locking mechanism.

4. The locking mechanism according to claim 1, wherein the processor is further configured to send to the lock clutch switching commands between the second position and the third position, according to a predetermined schedule.

5. The locking mechanism of claim 1 wherein the presence sensor is a camera configured to recognize a number of authorized users.

6. The locking mechanism according to claim 1, wherein the at least one identification key is a remote control and the processor is configured to receive from the remote control a switching command from any one of the three positions to any other one and to send to the lock clutch through a communication link said switching command.

7. A locking system comprising the locking mechanism according to claim 1 and the at least one identification key, wherein the at least one identification key comprises a transmitter of the identification code.

8. The locking system according to claim 7, wherein the at least one identification key is a remote control.

9. The locking system according to claim 7, wherein the at least one identification key is a remote control, and the remote control is a smart phone configured to receive the identification code from an external connection or generate the identification code.

10. A locking system comprising the locking mechanism according to claim 1, wherein the at least one identification key is an electronic key.

11. A method for switching a locking mechanism from a position to another one, the locking mechanism being configured to cooperate with at least one identification key having an identification code, the locking mechanism comprising an indoor mechanical actuation lever, an outdoor mechanical actuation lever and a lock clutch, the lock clutch being configured to take three positions:

a first position where the lock clutch is disengaged from the indoor mechanical actuation lever and outdoor mechanical actuation lever, a second position where the lock clutch is engaged with the indoor mechanical actuation lever and outdoor mechanical actuation lever, a third position where the lock clutch is engaged with the indoor mechanical actuation lever and disengaged from the outdoor mechanical actuation lever, each mechanical actuation lever being configured to switch between the closed configuration and the open configuration when moved if the identification code of the at least one identification key is an authorized code of the locking mechanism, the locking mechanism further comprising:

a processor configured to read the identification code of the at least one identification key and determine if the identification code is an authorized code of the locking mechanism, an access to a presence sensor, and the processor being further configured to send to the lock clutch switching commands to an engaged state when the presence sensor detects an authorized user to be present in the room as the authorized user was authorized to enter, and to be switched to a disengaged state when the presence sensor detects nobody to be present in the room, and wherein the method comprises:

cooperating the at least one identification key with the locking mechanism, moving the indoor, respectively outdoor, mechanical actuation lever, and switching the lock clutch depending on the switching command according to a determination by the sensor of a presence of a user.

12. The method of claim 11, wherein the cooperating the at least one identification key with the locking mechanism takes place in the vicinity of the locking mechanism and comprises a step of generating a code by an algorithm of the processor which is transmitted from the processor to the identification key.

13. The method according to claim 12 comprising:

reading the identification code of the at least one identification key by the processor, determining by the processor if the identification code is an authorized code of the locking mechanism.

* * * * *